United States Patent [19]

Buhrer

[11] Patent Number: 4,464,133

[45] Date of Patent: Aug. 7, 1984

[54] METHOD OF CHARGING A VESSEL WITH MERCURY

[75] Inventor: Carl F. Buhrer, Framingham, Mass.

[73] Assignee: GTE Laboratories Incorporated, Waltham, Mass.

[21] Appl. No.: 365,120

[22] Filed: Apr. 5, 1982

[51] Int. Cl.[3] ..... H01J 9/395

[52] U.S. Cl. ..... 445/9; 252/181.3; 445/19

[58] Field of Search ..... 445/9, 16, 19; 252/181.3

[56] References Cited

U.S. PATENT DOCUMENTS 1,855,901 4/1932 Bareiss et al. ..... 445/21 X
3,579,459 5/1971 Della Porta et al. ..... 252/181.3 X
3,657,589 4/1972 Della Porta et al. ..... 445/55 X

FOREIGN PATENT DOCUMENTS 52-6071 1/1977 Japan ..... 252/181.3

*Primary Examiner*—Kenneth J. Ramsey
*Attorney, Agent, or Firm*—J. Stephen Yeo

[57] ABSTRACT

A mercury-releasing assembly for dosing lamps, tubes, and the like with a charge of mercury, contains a mixture of an intermetallic compound of mercury and a metal. When the mixture is heated to a particular temperature the mixture reacts yielding a molten eutectic and mercury vapor. The mixture may be protected from contamination by a foil shield which ruptures under pressure of the released mercury.

3 Claims, 4 Drawing Figures

METHOD OF CHARGING A VESSEL WITH MERCURY

BACKGROUND OF THE INVENTION

This invention relates to mercury dosing of electrical discharge devices and, more particularly, to an improved mercury vapor generating composition and assembly which rapidly releases mercury vapor when the composition is elevated to a predetermined temperature.

A variety of electrical discharge devices, including mercury vapor rectifiers, cold cathode display devices, mercury arc lamps, and fluorescent lamps, contain fill gases in which mercury vapor is a key component. The mercury is introduced into the lamp or the like during manufacture. Liquid mercury, for example, can be introduced directly into a lamp during the exhaust cycle which occurs after the high temperature bake-out cycle of the discharge lamp is completed. However, this technique has several disadvantages. Control over the quantity of mercury introduced into the lamp is poor due to evaporation and exhaust during the cycle. Therefore, excess mercury, typically 2 to 3 times the required amount, is introduced into the lamp to ensure that a sufficient residual quantity remains. The mercury which escapes from the lamp during processing not only necessitates frequent cleaning of the vacuum system but also poses a health hazard to the operators of the vacuum system.

In another approach to mercury dosing, a glass or metal capsule containing a measured quantity of mercury is sealed within the discharge lamp. The mercury is released by thermal breaking of the capsule after the lamp is made. Although mercury vapors are reduced in the lamp production area, the use of the mercury containing capsule is not entirely satisfactory for other reasons.

A third approach to mercury dosing of electrical discharge devices utilizes mercury-containing intermetallic compounds which are sufficiently stable to withstand a discharge lamp bake-out cycle of about 600° C. yet which release mercury at a predetermined temperature above that of the bake-out cycle. The mercury-releasing composition is sealed into the discharge lamp and then is heated to release the mercury vapor. A mercury-releasing device containing an intermetallic compound of mercury with titanium or zirconium is disclosed in U.S. Pat. No. 3,657,589, issued Apr. 18, 1972 to Della Porta et al. The disclosed compounds, including $Ti_3Hg$, $Zr_3Hg$ and mixed compounds such as $Zr_2TiHg$, are sufficiently stable to permit high temperature outgassing of a discharge lamp at 500° C., lamp sealing and subsequent mercury emission at 550° C.–950° C. The time required to dispense all of the mercury depends on the temperature to which the composition is heated because the rate of mercury emission is dependent upon its diffusion out of the solid intermetallic compound. The disclosed compositions typically require 25–30 seconds at temperatures over 900° C. for suitable mercury vapor emission. Since fluorescent lamps are typically processed on a production line at a rate of one per second, an emission time of 30 seconds necessitates simultaneous heating of at least 30 lamps.

It is therefore an object of the invention to provide a mercury-releasing device and compound which has a low mercury vapor pressure up to 600° C. A further object is to provide a compound which rapidly releases mercury at a predetermined temperature between 770° C. and 1280° C. In releasing device and compound which does not release gases which would contaminate the discharge device when heated to release mercury.

SUMMARY OF THE INVENTION

According to the present invention, these and other objects and advantages, are achieved in a mercury-releasing device comprising a mercury vapor generating composition and a holder for the composition. The mercury vapor generating composition comprises an intermetallic compound of mercury and a material selected from the group consisting of zirconium, titanium, and combinations thereof mixed with a metal selected from the group consisting of nickel, copper, and combinations thereof. The relative proportions of the intermetallic compound and the metal are selected to provide reaction and melting between the material and the metal at a predetermined temperature between 770° C. and 1280° C. whereupon mercury vapor is rapidly released from the compositions. The composition may be held by an iron or steel cup. The composition may also be pressed into a wire mesh supported by a piece of iron or steel. In both arrangements, the composition may be protected from contamination by a rupturable metal foil that dissolves into the melt.

BRIEF DESCRIPTION OF THE DRAWINGS

FIGS. 1A, 1B, 2A and 2B are examples of mercury-releasing assemblies for holding the composition of the invention within a lamp, tube, or the like.

DESCRIPTION OF THE INVENTION

Figure 1A:
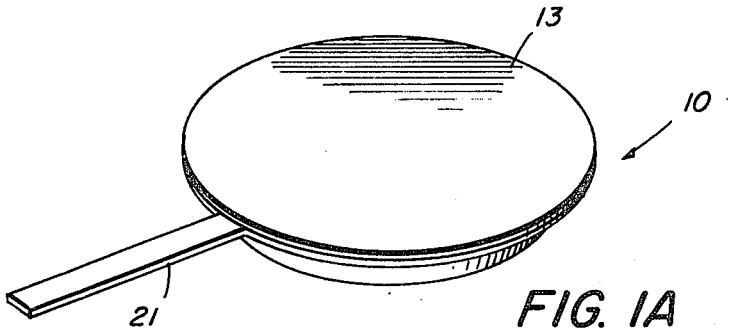

According to the invention an intermetallic compound of mercury is mixed with a metal. Upon heating this mixture undergoes a reaction resulting in a sudden melting of the mixture and a rapid evolution of mercury. The intermetallic compound of mercury is chosen to include one or more metals of Group IVB of the Periodic Table, and preferably is $Ti_3Hg$ and $Zr_3Hg$ which are known to have good thermal stability. The metal is chosen from Groups VIII or IB of the Periodic Table and is preferably nickel or copper or an alloy thereof. Both nickel and copper will form eutectics with titanium and zirconium.

Hansen: *Constitution of Binary Alloys,* 2nd edition published by McGraw Hill Book Co. has phase diagrams of Ni-Ti, Ni-Zr, Cu-Ti, and Cu-Zr systems. There it can be seen that a binary eutectic composition of 28.5 wt.% Ni and 71.5 wt% Ti melts at approximately 950° C.; of 17 Wt.% Ni and 83 wt.% Zr melts at 961° C.; of 50 wt.% Cu and 50 wt.% Ti melts at about 975° C.; and of 58.9 wt.% Cu and 41.1 wt.% Zr melts at about 890° C. With other eutectic proportions of Ti and Ni melting temperatures of 770° C. to 1280° C. may be obtained.

The eutectic melting temperatures are seen to be much lower than the melting points of elemental titanium and zirconium which are 1668° C. and 1852° C. respectively or nickel and copper, which are 1453° C. and 1083° C. respectively.

Ternary and quaternary eutectics are also known, so that as a feature of the invention, the mixture may include three or four metals.

In the preferred composition, the intermetallic compound is $Ti_3Hg$ and the elemental metal is Ni. A weight ratio of six parts of pure $Ti_3Hg$ to one part Ni corresponds to the binary Ni-Ti eutectic composition of 28.5 wt.% Ni.

The intermetallic compound and the metal are ground or otherwise divided into particles fine enough to pass through a 325 mesh per inch screen. The particulate components are mixed as solids and the resulting composition is pressed into a crucible or holder adapted for insertion into a lamp, tube, or the like. The components preferably have a weight ratio corresponding to a eutectic composition. The crucible or holder must be capable of holding the molten eutectic without disintegrating and yet capable of releasing mercury vapor. Iron and steel are suitable at these temperatures and are wet by the molten eutectic thereby allowing it to spread over a larger area. Either metal may be used as a support carrier.

It has been found that the intermetallic compound, particularly $Ti_3Hg$, reacts with water vapor and other volatile compounds during lamp processing at or below 600° C. forming oxides and hydrides. After the lamp is sealed and when the compound is eventually heated to over 600° C. it gives off hydrogen which can make the lamp or the like non-functional. These contaminations can be absorbed by a getter, but a getter is an additional expense to be avoided.

As a feature of the invention the components are sealed off from contamination in the ambient atmosphere during processing of the lamp or the like, thereby preventing absorption of water and hydrogen in the first place.

Figure 1B:
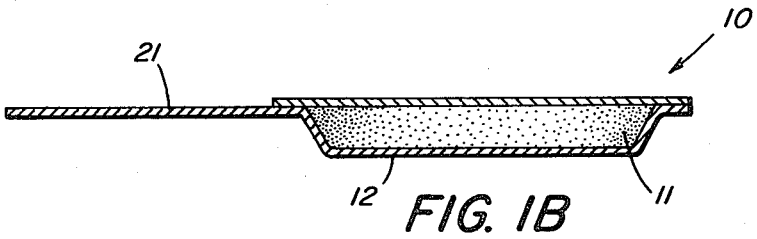

In the mercury-releasing assembly 10 shown in cross-section by FIG. 1, the mixed components 11 are pressed into a steel cup 12. The opening of the cup is then weld sealed with nickel or copper foil 13 for preventing subsequent contamination of the components 11. Later, when the assembly 10 is heated, the foil 13 ruptures under the pressure of the released mercury or by dissolution into the molten eutectic. Tab 21 is used to support the cup and is welded to a support wire within the lamp or the like.

Figure 2A:
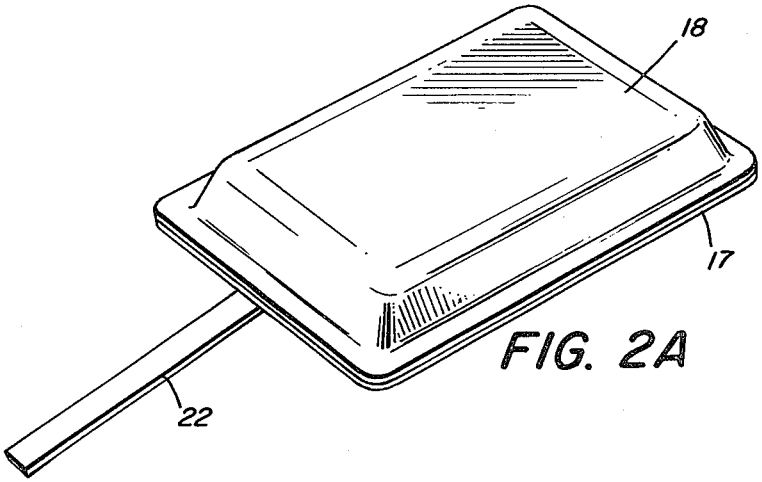
Figure 2B:
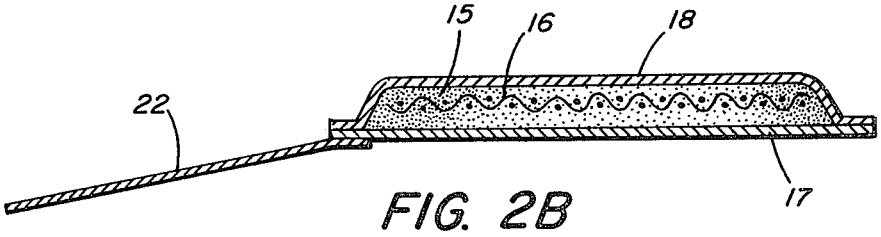

In the mercury-releasing assembly seen in cross-section in FIG. 2, the mixed components 15 are pressed by a roller into the mesh of a metal screen 16 backed by support piece 17 of iron or steel to help retain the molten composition. The screen metal may be steel which substantially resists the eutectic melt or it may be nickel or copper which rapidly dissolve in it. A layer of nickel or copper foil 18 may be used to seal the components from the atmosphere until the foil is ruptured by the pressure of the released mercury or by dissolution of the nickel or copper into the eutectic melt in contact with it. Both the nickel and the copper of the screen and the foil will melt with the components, and the amount of nickel or copper in the foil and screen can offset the amount of nickel and copper used in the mixture. Tab 22 aids mounting.

These mercury dispensing assemblies can be shaped into any configuration suitable for mounting within the lamp or the like by means of support tabs or fasteners.

The mercury dispensing assembly is mounted within the lamp or the like which is then further processed at temperatures below 600° C. The lamp or the like may be filled with rare gas, if desired, and sealed. The mercury dispensing device is then heated resistively by radio frequency energy or other means to the eutectic temperature.

As the temperature increases, mercury is gradually released by decomposition of the intermetallic compound. The mercury must diffuse through the solid phase of the mixture until the mixture reaches the eutectic temperature where upon the mixture undergoes a sudden melting into a liquid phase. The mercury is then rapidly released from the decomposition of the intermetallic compound and passes easily through the molten composition to the surface of the melt where, due to its high vapor pressure at these temperatures, it flash evaporates. Close to one hundred percent of the available mercury is evaporated within five or ten seconds, leaving a molten eutectic.

The described mercury-releasing assemblies and compositions are stable at the temperatures used to bake-out lamps and the like but when heated to a predetermined temperature will much more rapidly release mercury vapor than will other devices having intermetallic compounds of mercury. The predetermined temperature is dependent on which eutectic is chosen and may range from about 770° C. to 1280° C. for Ti-Ni eutectics.

While there has been shown and described what are at the present considered the preferred embodiments of the invention, it will be obvious to those skilled in the art that various changes and modifications may be made therein without departing from the scope of the invention as defined by the claims.

What is claimed is:

1. A method of charging a lamp, electronic tube or the like with mercury, the method comprised of the steps of: preparing a composition of a particulate intermetallic compound of mercury and one or more first metals selected from the group consisting of zirconium and titanium and a particulate second metal selected from the group of nickel or copper, wherein the weight ratio of said first metal to said second metal is that of an eutectic of said metals; inserting said composition into said lamp, tube or the like; sealing said lamp, tube or the like, and heating said composition to a temperature sufficient to cause said composition to reactively melt releasing mercury as a vapor flash and yielding an eutectic of said metals.

2. The method of claim 1 wherein said composition is comprised of particulate $Ti_3Hg$ and particulate Ni wherein the weight ratio of $Ti_3Hg$ to Ni is approximately 6:1 and said temperature is approximately 950° C.

3. The method of claims 1 or 2 wherein said composition is sealed from contamination by a rupturable metal foil.

* * * * *